US005542554A

United States Patent [19]

Resnick

[11] Patent Number: 5,542,554

[45] Date of Patent: Aug. 6, 1996

[54] DISPLAY STAND

[76] Inventor: Michael Resnick, 9830 Huber La., Niles, Ill. 60714

[21] Appl. No.: 407,278

[22] Filed: Mar. 20, 1995

[51] Int. Cl.[6] ..... A47B 43/00

[52] U.S. Cl. ..... 211/186; 211/189; 312/223.5

[58] Field of Search ..... 211/186, 133, 211/134, 126, 189, 50; 312/223.5, 114

[56] References Cited

U.S. PATENT DOCUMENTS 3,115,719 12/1963 Mapson ..... 312/114

4,118,082 10/1978 Hoop ..... 312/223.5

4,633,788 1/1987 Robertson ..... 211/189

*Primary Examiner*—Leslie A. Braun

*Assistant Examiner*—Willie W. Berry, Jr.

*Attorney, Agent, or Firm*—Richard W. Carpenter

[57] ABSTRACT

An illuminated, kiosk type, display stand designed for use in holding and attractively displaying various articles of merchandise or other items or materials. The stand is formed of a pair of hollow, molded plastic, front and rear units that are secured to each other and mounted on a separate base unit.

20 Claims, 2 Drawing Sheets

FIG. 1
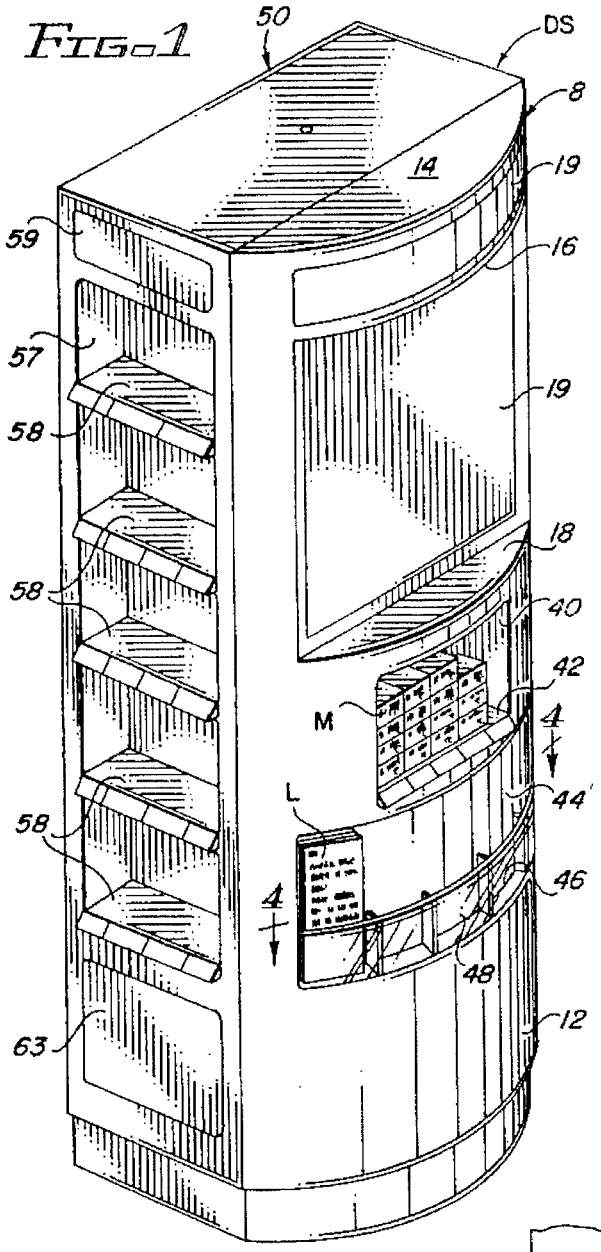
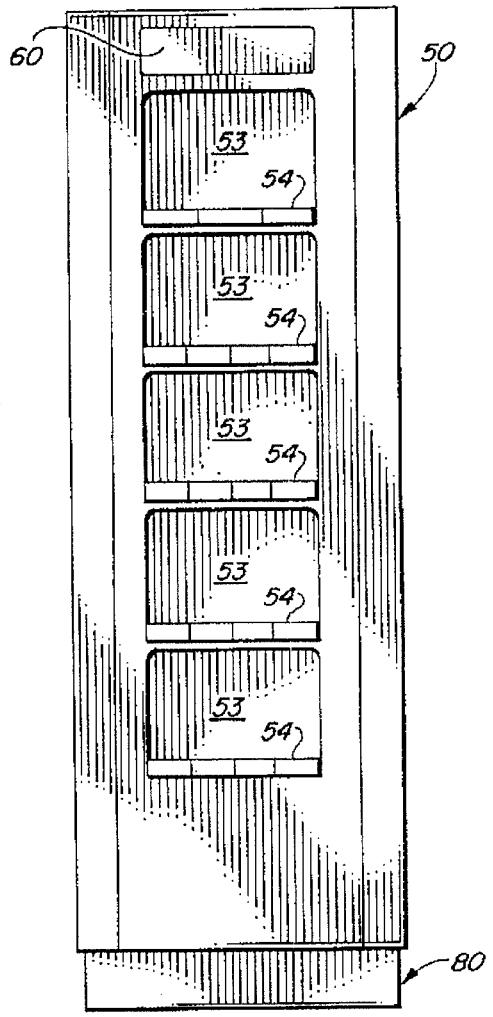
FIG. 2
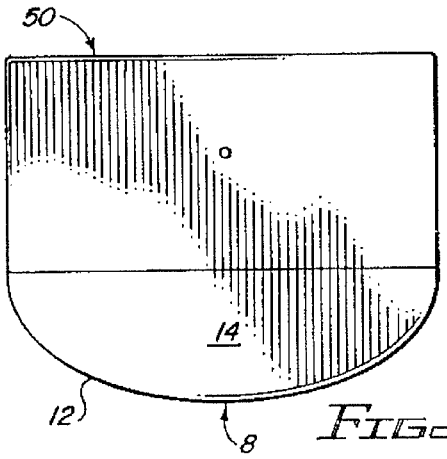
FIG. 3
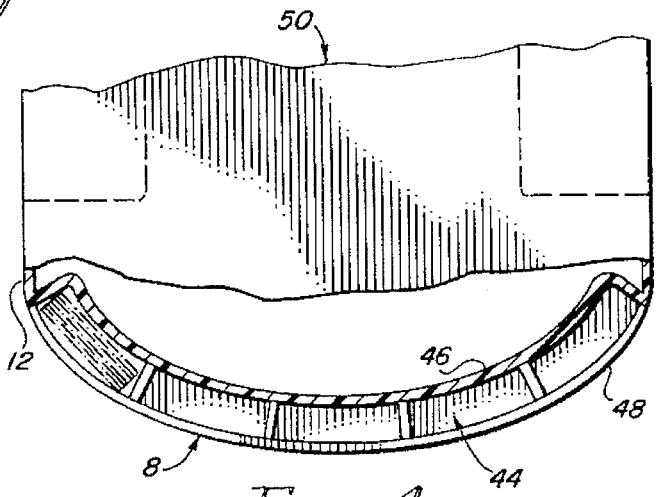
FIG. 4

DISPLAY STAND

BACKGROUND OF THE INVENTION

1. Field of the Invention

This invention relates to display stands of the type used to hold and display merchandise or other items, and more particularly to an illuminated, kiosk type, display stand formed from molded plastic material.

2. Description of the Background Art

A background art search directed to the subject matter of this invention conducted in the United States Patent and Trademark Office disclosed the following United States Letters Patent:

| | | | |
|---|---|---|---|
| 2,070,641 | 2,686,703 | 3,054,212 | 3,722,733 |
| 3,997,220 | 4,103,782 | 4,118,082 | 4,300,248 |
| Des. 279,746 | Des. 316,637 | Des. 325,480 | Des. 335,978 |

None of the patents uncovered in the search discloses a kiosk type, illuminated, display stand formed of a pair of hollow, molded plastic, front and rear units that are secured to each other and mounted on a base.

SUMMARY OF THE INVENTION

It is a primary object of the invention to provide an illuminated, kiosk type, display stand designed for use in holding and attractively displaying various articles of merchandise and/or other items or materials.

Another object of the invention is the provision of a display stand of the type described that can be easily and economically manufactured.

A more specific object of the invention is to provide a kiosk type, illuminated, display stand formed of a pair of hollow, molded plastic, front and rear units that are secured to each other and mounted on a base.

These and other objects of the invention will be apparent from an examination of the following description and drawings.

BRIEF DESCRIPTION OF THE DRAWINGS

FIG. 1 is an isometric view of a display stand embodying features of the present invention;

FIG. 2 a rear side elevational view of the structure illustrated in FIG. 1;

FIG. 3 is a top plan view of the structure illustrated in FIG. 1;

FIG. 4 is a partial horizontal sectional view taken on line 4—4 of FIG 1.

Figure 5:
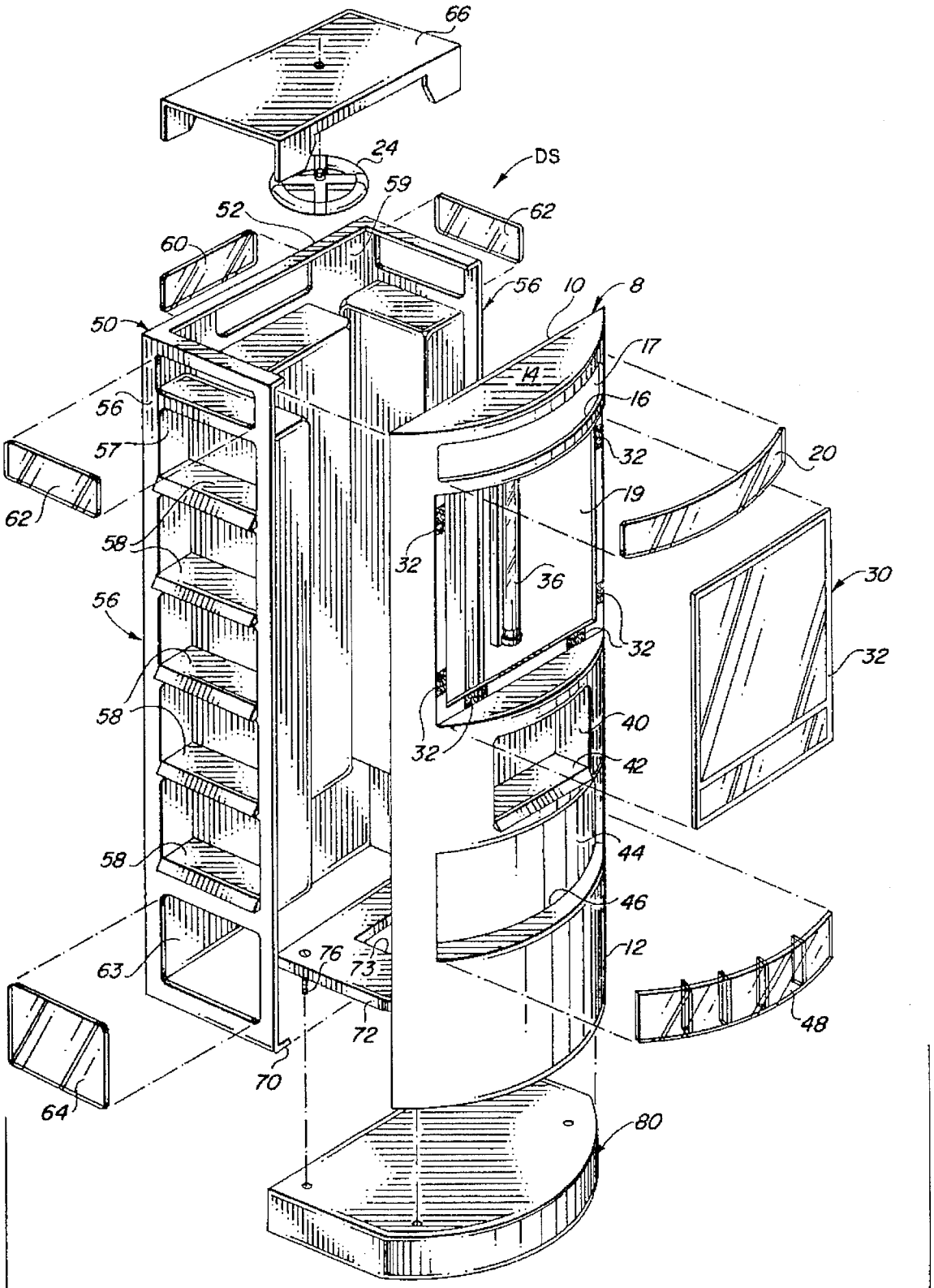
FIG. 5 is an exploded isometric view of the structure illustrated in FIG. 1.

It will be understood that, for purposes of clarity, certain elements may have been omitted from certain views where they are believed to be illustrated to better advantage in other views.

DESCRIPTION OF THE PREFERRED EMBODIMENT

Referring now to the drawings for a better understanding of the invention, it will be seen that the display stand indicated generally at DS in FIGS. 1 and 5 is formed from a pair of generally hollow, vacuum formed, molded plastic, front and rear units 8 and 50, respectively, which are secured to each other and mounted on 8 base 80, in 8 manner hereinafter described.

The front and rear units are each relatively hollow structures that are preferably made from vacuum formed, molded plastic material. As best seen in FIG. 5, front unit 8 is generally semi-cylindrical in shape and includes a flat, vertical, rear wall 10 and an integral, curved, vertical, front wall 12 extending forwardly from opposed side edges of the rear wall.

The upper and lower ends of the front unit are enclosed by a pair of flat, horizontal, semi-circular top and bottom walls 14. Within the front unit are another pair of flat horizontal, semi-circular, integral, upper and lower inner walls 16 and 18.

Upper inner wall 16 is located a relatively short distance below top wall 14 and defines, with top wall 14, an upper illuminated compartment 17 that is open at the front and rear and that communicates with a related, adjacent, upper compartment 59 of the rear unit 50, as hereinafter described.

Lower inner wall 18 is located approximately midway between top and bottom walls 14 and defines, with upper inner wall 16, a central illuminated compartment 19 that is larger than upper illuminated compartment 17 and that is also open at the front.

A light permeable upper sign panel 20 may be removably attached, in any desired manner (not shown), to the front unit front wall 12, so as to cover the front of the opening to the upper compartment 17. Sign panel 20 may be illuminated by a light fixture 24 located in the adjacent, communicating, rear unit upper compartment 59, A larger, light permeable, preferably 3-D, lenticular, translite, main sign panel 30, mounted in a frame 32, may be also removably attached, by means of VELCRO fasteners 34, to the front unit front wall 12, so as to cover the opening to central compartment 19. The sign panel may be illuminated by a light 36 located at the rear of central compartment 19.

As best seen in FIG. 1, the front unit front wall 12 may also be provided with a recessed compartment 40 for holding and displaying merchandise M or other items. This compartment is located below central compartment 19 and includes a lower wall or shelf 42.

Additionally, there may be provided yet another recessed compartment 44 for holding and displaying literature L or other items. This compartment includes a lower wall or shelf 46 and a front retaining bar or rail 48 .

Turning now to FIG. 5 of the drawings, it will be seen that rear unit 50 of the display stand DS is generally U-shaped, as seen from the top, and includes a center section 52 and a pair of integral side sections 56 extending outwardly from opposite sides of the center section.

As best seen in FIG. 2, center section has an elongated, vertically extending, recessed compartment 53 which is provided with a plurality of integral, vertically spaced, horizontal shelves 54 for holding and for displaying merchandise or other items.

Each side section 56 also has an elongated, vertically extending, recessed compartment 57 which is provided with a plurality of integral, vertically spaced, horizontal shelves 58 for holding and displaying merchandise or other items, At the upper extremity of rear unit 50, there is an upper compartment 59, which is in communication with front unit upper compartment 17. Compartment 59 is located above the recessed compartments of the center and side sections of the rear unit and has openings in through the center and side sections.

Light permeable upper sign panels 60 and 62 may be removably attached to the center and side units at these openings and may be illuminated by the previously mentioned illuminating device 24, which is located in compartment 59 of the rear unit, and which also serves to illuminate the upper sign panel 20 of the front unit.

The lower portions of the rear unit side sections 56 may also be provided with recesses 63 for receiving non-illuminated, lower sign panels 64, As best seen in FIG. 5, the open upper end of rear unit upper compartment 59 may be covered and closed by a removable top or cover 66.

Now to describe the assembly of the display stand. After the front and rear units 8 and 50 have been formed, rear unit 50 is attached to a wooden base by means of screws 76 which, as best seen in FIG. 5, extend through a wooden plate 72 and through rear unit horizontal lower flanges 70 into the separate wood base 80.

After the rear unit 50 has been secured to the base 80, the units are moved together, and the rear wall 10 of the front unit 8 is positioned against and adhesively secured to the front surfaces of the rear unit side section compartments 57.

Additionally, elongated, vertically extending fastening beads or strips (not shown) may be attached to the stand to cover the joints between the front and rear units.

Thus, it will seen that the invention provides a unique and extremely attractive, illuminated display stand, for holding and displaying merchandise, literature, and/or other items, that is relatively light weight and economical to manufacture.

What is claimed is:

1. A kiosk style display stand for holding and displaying articles, said cabinet comprising:

(a) a horizontally disposed base;

(b) pair of generally hollow, molded plastic, front and rear units secured to each other and mounted on said base;

(c) said rear unit being generally U-shaped in horizontal cross-section, having a rear section flanked by a pair of integral side sections, and including:

at least one recessed, article holding compartment in each of said rear and side sections;

(ii) a recessed, first lighting compartment having positioned therein means for illuminating one or more sign panels;

(iii) light permeable sign panels removably attached to said rear and side sections adjacent said lighting compartment;

(d) said front unit being generally semi-cylindrical in horizontal cross-section, having a flat rear wall and an integral curved front wall, and including:

(i) at least one recessed, article holding compartment;

(ii) a second recessed, lighting compartment having positioned therein means for illuminating a light permeable sign panel;

(iii) a third recessed, lighting compartment in said rear wall in communication with said rear unit first lighting compartment;

(iv) light permeable sign panels removably attached to said front wall adjacent each of said front unit lighting compartments.

2. A display stand according to claim 1, wherein each of said rear unit center and side section recessed, article holding compartments includes a plurality of vertically spaced shelves.

3. A display stand according to claim 1, wherein said rear unit lighting compartment is located immediately above said rear unit recessed article holding compartments.

4. A display stand according to claim 1, wherein said front unit has an additional recessed article holding compartment and an article retaining element in front thereof.

5. A display stand according to claim 1, wherein one of said front unit sign panels is a lenticular translite that provides a 3-D effect.

6. A kiosk style display stand for holding and displaying articles, said cabinet comprising:

(a) pair of generally hollow, molded plastic, front and rear units secured to each other;

(b) said rear unit being generally U-shaped in horizontal cross-section, having a rear section flanked by a pair of integral side sections, and including:

(i) at least one recessed, article holding compartment in each of said rear and side sections;

(ii) a recessed, lighting compartment having positioned therein means for illuminating one or more sign panels;

(iii) light permeable sign panels removably attached to certain of said rear and side sections adjacent said lighting compartment;

(c) said front unit being generally semi-cylindrical in horizontal cross-section, having a curved front wall, and including:

(i) at least one recessed, article holding compartment;

(ii) a recessed, lighting compartment having positioned therein means for illuminating a light permeable sign panel;

(iii) at least one light permeable sign panel removably attached to said front wall adjacent said front unit lighting compartment.

7. A display stand according to claim 6, wherein each of said rear unit center and side section recessed, article holding compartments includes a plurality of vertically spaced shelves.

8. A display stand according to claim 6, wherein said rear unit lighting compartment is located immediately above said rear unit recessed article holding compartments.

9. A display stand according to claim 6, wherein said front unit has an additional recessed article holding compartment and an article retaining element in front thereof.

10. A display stand according to claim 6, wherein said front unit sign panel is a lenticular translite that provides a 3-D effect.

11. A display stand according to claim 6, wherein said front and rear units are mounted on a separate base unit.

12. A display stand according to claim 6, wherein said front unit has another recessed, lighting compartment in communication with said rear unit lighting compartment.

13. A kiosk style display stand for holding and displaying articles, said cabinet comprising:

(a) pair of generally hollow, molded plastic, front and rear units secured to each other;

(b) said rear unit being generally U-shaped in horizontal cross-section, having a rear section flanked by a pair of integral side sections, and including:

(i) at least one recessed, article holding compartment in each of said rear and side sections;

(ii) a recessed, lighting compartment;

(iii) light permeable sign panels removably attached to certain of said rear and side sections adjacent said rear unit lighting compartment;

(c) said front unit being generally semi-cylindrical in horizontal cross-section, having a curved front wall, and including:

(i) at least one recessed, article holding compartment;

(i) a recessed, lighting compartment;

(iii) at least one light permeable sign panel removably attached to said front wall adjacent said front unit lighting compartment;

(d) illuminating means located in at least one of said lighting compartments for illuminating said sign panels.

14. A display stand according to claim 13, wherein each of said rear unit center and side section recessed, article holding compartments includes a plurality of vertically spaced shelves.

15. A display stand according to claim 13, wherein said rear unit lighting compartment is located immediately above said rear unit recessed article holding compartments.

16. A display stand according to claim 13, wherein said front unit has an additional recessed article holding compartment and an article retaining element in front thereof.

17. A display stand according to claim 13, wherein said front unit sign panel is a lenticular translite that provides a 3-D effect.

18. A display stand according to claim 13, wherein said front and rear units are mounted on a separate base unit.

19. A display stand according to claim 13, wherein said front unit has another recessed, lighting compartment in communication with said rear unit lighting compartment.

20. A display stand according to claim 13, wherein illuminating means is located in a lighting compartment of one of said front and rear units and is operable to illuminate said front and rear sign panels.

* * * * *